US009808125B2

(12) United States Patent
Jepson

(10) Patent No.: US 9,808,125 B2
(45) Date of Patent: Nov. 7, 2017

(54) VERTICALLY ADJUSTABLE SHOWER CADDY AND METHOD FOR TENSIONING SAME

(71) Applicant: ARTIKA FOR LIVING INC., Dorval, Quebec (CA)

(72) Inventor: Raymond Jepson, Roxboro (CA)

(73) Assignee: ARTIKA FOR LIVING INC., Dorval (CA)

( * ) Notice: Subject to any disclaimer, the term of this patent is extended or adjusted under 35 U.S.C. 154(b) by 14 days.

(21) Appl. No.: 15/254,013

(22) Filed: Sep. 1, 2016

(65) Prior Publication Data

US 2017/0055780 A1 Mar. 2, 2017

Related U.S. Application Data

(60) Provisional application No. 62/212,962, filed on Sep. 1, 2015.

(51) Int. Cl.

| | |
|---|---|
| ***A47G 29/087*** | (2006.01) |
| ***A47K 3/28*** | (2006.01) |
| ***A47K 5/00*** | (2006.01) |
| *A47B 96/14* | (2006.01) |
| *A47F 5/00* | (2006.01) |
| *D06F 57/12* | (2006.01) |

(52) U.S. Cl.

CPC ..... *A47K 3/281* (2013.01); *A47K 5/00* (2013.01); *A47B 96/1425* (2013.01); *A47F 5/00* (2013.01); *A47K 2201/00* (2013.01); *D06F 57/12* (2013.01)

(58) Field of Classification Search

CPC ..... F16M 11/26; F16M 11/28; F16B 7/10; A47K 3/281; A47K 5/00; A47K 2201/00; A47F 5/00; D06F 57/12

USPC ... 211/119.009, 86.01, 196, 90.02, 107, 103, 211/205, 123, 124, 105.1–105.6; 248/220.1, 200.1, 422, 408; 33/809–812; 108/147, 149

See application file for complete search history.

(56) References Cited

U.S. PATENT DOCUMENTS

| | | | | | |
|---|---|---|---|---|---|
| 251,698 | A * | 1/1882 | Coats | B66F 3/08 | 211/123 |
| 254,262 | A * | 2/1882 | Beihl | B66F 3/02 | 248/422 |
| 392,259 | A * | 11/1888 | Carr | A47G 25/18 | 211/115 |
| 520,584 | A * | 5/1894 | Turner | A47H 1/022 | 211/105.4 |

(Continued)

*Primary Examiner* — Joshua J Michener
*Assistant Examiner* — Devin Barnett
(74) *Attorney, Agent, or Firm* — Robert Brouillette; Brouillette Legal Inc.

(57) ABSTRACT

A vertically adjustable shower caddy system comprising a tension pole, a number of shelves and a number of securing element for attaching and reattaching the shelves and accessories to the tension pole. The tension pole is installed using an integrated tensioning mechanism allowing extension of the top and bottom extremities as to apply tension to the bath or shower floor and ceiling. The securing element uses clips that are opened and closed when attaching and reattaching the shelves to the tension pole rail. Repositioning a shelf to a new location on the tension pole therefore does not require the removal of the tension pole from a shower stall or bathtub/shower area, thereby saving a user a significant amount of time and effort.

14 Claims, 8 Drawing Sheets

(56) References Cited

U.S. PATENT DOCUMENTS 527,273 A * 10/1894 Fowler ..... A47H 1/022 211/105.6
561,210 A * 6/1896 Downey ..... A47B 96/1425 211/100
565,546 A * 8/1896 Kingston ..... A47H 1/022 211/105.4
626,739 A * 6/1899 Vanderman ..... A47K 1/09 211/119.009
645,543 A * 3/1900 Birch ..... A47H 1/022 211/105.6
670,585 A * 3/1901 Fowler ..... A47H 1/022 211/105.4
891,897 A * 6/1908 Astrom ..... E02D 17/04 16/13
961,352 A * 6/1910 Walters ..... A47H 1/022 211/105.6
974,398 A * 11/1910 Lathrop ..... A47H 1/022 211/105.3
988,200 A * 3/1911 Logsdon ..... A47H 1/022 211/105.6
1,114,896 A * 10/1914 MacRae ..... A47C 3/26 248/408
1,225,611 A * 5/1917 Gatlin ..... A47G 25/0692 211/123
1,253,486 A * 1/1918 Hammer ..... A47H 1/022 211/105.4
1,414,289 A * 4/1922 Kubiak ..... A47H 1/022 211/105.6
1,581,463 A * 4/1926 Moors ..... D06F 57/04 211/207
1,639,551 A * 8/1927 Booth ..... A47H 1/022 211/105.6
1,641,832 A * 9/1927 Skinner ..... A47B 61/00 211/62
1,705,625 A * 3/1929 Mitchell ..... F16B 7/10 16/429
1,951,660 A * 3/1934 Klaudt ..... A47H 1/022 16/94 D
2,032,842 A * 3/1936 Gould ..... A47H 1/022 211/105.6
2,129,425 A * 9/1938 Jenks ..... D06F 57/04 211/107
2,129,426 A * 9/1938 Jenks ..... D06F 57/04 211/107
2,680,668 A * 6/1954 Stanfiel ..... F25D 25/027 211/107
2,835,527 A * 5/1958 Young ..... H01M 2/1011 294/16
2,941,669 A * 6/1960 Palay ..... A47B 96/1425 211/1.55
2,973,870 A * 3/1961 Schoos ..... A47H 1/022 211/105.6
2,974,805 A * 3/1961 Brossean ..... A47H 1/022 211/105.5
2,974,806 A * 3/1961 Seewack ..... A47H 1/102 211/105.4
2,991,040 A * 7/1961 Levy ..... A47F 5/08 108/108
3,001,754 A * 9/1961 Fowler ..... A47F 5/06 211/105.3
3,022,974 A * 2/1962 Knodel ..... A47B 57/545 248/200.1
3,035,708 A * 5/1962 Freeman ..... A47B 96/1425 108/147.19
3,089,742 A * 5/1963 Powell ..... B60P 3/14 108/134
D195,412 S * 6/1963 Vernik ..... D6/407
3,094,007 A * 6/1963 Luhrs ..... A47B 1/10 108/87
3,221,678 A * 12/1965 Doherty ..... A47B 57/26 108/106
3,291,434 A * 12/1966 Whitechester ..... A47B 96/1425 211/86.01
3,521,341 A * 7/1970 Hornlein ..... A47B 9/20 248/161
3,570,412 A * 3/1971 Holman, Jr. ..... B61D 45/001 211/105.6
3,595,209 A * 7/1971 Parker ..... A01K 15/024 119/706
D222,276 S * 10/1971 Hughes ..... 108/151
3,836,174 A * 9/1974 Holman, Jr. ..... B60P 7/15 211/105.6
4,037,726 A * 7/1977 Schweers ..... A47H 1/022 211/105.5
4,087,006 A * 5/1978 Schill ..... A47K 3/001 211/105.6
4,101,036 A * 7/1978 Craig ..... A47B 96/1425 211/107
4,103,781 A * 8/1978 Sterling ..... D06F 57/12 211/119.009
4,192,426 A * 3/1980 Gauthier ..... D06F 57/122 211/105.4
4,232,790 A * 11/1980 Serrano ..... G11B 33/0466 211/163
4,339,104 A * 7/1982 Weidman ..... F16M 11/10 248/407
D273,645 S * 5/1984 McEvers ..... D6/513
4,641,815 A * 2/1987 Yu ..... B66F 3/42 254/93 H
4,771,899 A * 9/1988 Benedict ..... A47G 25/746 211/105.3
4,776,471 A * 10/1988 Elkins ..... A47B 81/005 211/64
4,807,837 A * 2/1989 Gawlik ..... A61M 5/1415 211/196
4,819,817 A * 4/1989 Mar ..... A47F 5/08 211/196
4,938,623 A * 7/1990 Alexander ..... A61G 5/10 280/304.1
5,086,930 A * 2/1992 Saeks ..... B62H 3/12 211/17
5,104,269 A * 4/1992 Hardison ..... B61D 45/00 211/105.3
5,127,528 A * 7/1992 Cone ..... A47B 96/1425 211/163
5,190,170 A * 3/1993 Steiner ..... A47G 25/0685 211/104
5,284,260 A * 2/1994 Caligiuri, Sr. ..... A47B 96/1425 211/107
5,303,832 A * 4/1994 Tu ..... A47B 96/1425 211/105.4
5,318,175 A * 6/1994 Stevens ..... A47G 25/0664 211/107
5,330,061 A * 7/1994 Geltz ..... A47K 3/38 211/105.4
5,458,243 A * 10/1995 McBride ..... A47B 57/30 206/503
5,558,501 A * 9/1996 Wang ..... F04D 29/601 248/159
5,639,175 A * 6/1997 Emoto ..... A47B 57/06 248/405
5,702,010 A * 12/1997 Liang ..... D06F 57/122 211/105.1
5,715,954 A * 2/1998 Zaremba ..... A47F 5/04 211/107
5,833,081 A * 11/1998 Smith ..... B60R 7/10 211/204
5,857,657 A * 1/1999 Yamamoto ..... F16M 11/28 248/406.1
5,876,011 A * 3/1999 Blasing ..... F16M 11/28 248/170
5,881,601 A * 3/1999 Hammer ..... B25G 1/04 294/210
D407,920 S * 4/1999 Duffield ..... D6/677.1
5,897,085 A * 4/1999 Cronin ..... A47B 96/1425 248/200.1
D421,692 S * 3/2000 Wojtowicz ..... D6/525

(56) References Cited

U.S. PATENT DOCUMENTS

D421,867 S * 3/2000 Carville ..... D6/525
D429,934 S * 8/2000 Hofman ..... D6/525
6,152,434 A * 11/2000 Gluck ..... E04F 21/1805 254/114
6,233,877 B1 * 5/2001 Monroe ..... A62B 1/04 182/230
6,247,882 B1 * 6/2001 Huang ..... B60P 7/15 410/143
6,390,746 B1 * 5/2002 Huang ..... B60P 7/15 410/143
6,520,351 B1 * 2/2003 Zadro ..... A47K 3/281 211/106
6,554,235 B1 * 4/2003 Fortier ..... A47B 57/565 248/122.1
D475,560 S * 6/2003 Suero, Jr. ..... A47K 3/281 D6/525
6,594,910 B2 * 7/2003 Wishart ..... E04G 21/1808 33/281
6,688,238 B1 * 2/2004 Alexiou ..... A47K 3/281 108/42
6,804,893 B2 * 10/2004 Watson ..... G01C 15/004 33/286
6,851,652 B1 * 2/2005 Huang ..... E04G 25/08 248/200.1
D543,747 S * 6/2007 Harwanko ..... D6/525
D566,991 S * 4/2008 Harwanko ..... D6/525
D569,148 S * 5/2008 Yang ..... D6/525
D573,387 S * 7/2008 Walker ..... D6/525
7,533,712 B2 * 5/2009 Whittemore ..... E04G 21/30 160/368.1
D628,841 S * 12/2010 Yang ..... D6/525
D635,807 S * 4/2011 Lindo ..... D6/525
D641,193 S * 7/2011 Vaccaro ..... D6/525
8,052,110 B2 * 11/2011 Wang ..... E04G 25/06 248/354.1
D651,838 S * 1/2012 Yang ..... D6/525
D688,064 S * 8/2013 Couture ..... D6/562
8,800,072 B2 * 8/2014 Chang ..... A47K 3/38 160/333
8,806,670 B2 * 8/2014 O'Connell ..... A47K 3/38 211/105.1
8,894,099 B2 * 11/2014 Cordes ..... A47L 9/244 285/298
8,925,747 B1 * 1/2015 Hanley ..... A47H 1/022 211/105.6
8,973,899 B2 * 3/2015 Buckingham ..... E04G 25/061 254/105
9,021,627 B2 * 5/2015 Parker ..... A47K 3/38 211/105.4
D734,956 S * 7/2015 Yang ..... D6/525
9,192,958 B2 * 11/2015 Vito ..... B05C 17/00
9,302,198 B1 * 4/2016 Faver ..... A63J 11/00
2003/0132181 A1 * 7/2003 Saulnier-Matteini .. A47B 45/00 211/153
2003/0183593 A1 * 10/2003 Samelson ..... A47K 3/38 211/105.3
2003/0222191 A1 * 12/2003 Tsai ..... A47F 5/0006 248/354.1
2004/0079845 A1 * 4/2004 Wilcox ..... F16B 7/1463 248/188.5
2004/0217239 A1 * 11/2004 Chuang ..... A47B 96/1425 248/125.8
2005/0103962 A1 * 5/2005 Tsay ..... F16B 47/00 248/317
2005/0205729 A1 * 9/2005 Wang ..... A45B 7/005 248/161
2006/0011787 A1 * 1/2006 Law ..... A47J 37/0786 248/121
2006/0186284 A1 * 8/2006 Root ..... F16B 7/1472 248/161
2007/0215781 A1 * 9/2007 Watt ..... A63B 22/0046 248/622
2008/0272252 A1 * 11/2008 Conde ..... A47B 96/1425 248/146
2010/0133218 A1 * 6/2010 Yang ..... A47K 3/281 211/119.009
2010/0237032 A1 * 9/2010 Whitehall ..... A47B 57/26 211/107
2011/0225903 A1 * 9/2011 Lounis ..... B66F 11/00 52/122.1
2011/0284484 A1 * 11/2011 Lin ..... A47B 96/1425 211/45
2012/0205333 A1 * 8/2012 Sagel ..... A47B 49/006 211/86.01
2012/0217215 A1 * 8/2012 Emery ..... A47K 3/281 211/119.009
2013/0334156 A1 * 12/2013 Baines ..... A47B 55/00 211/134
2015/0153000 A1 * 6/2015 Clinton ..... F16M 13/027 248/333
2015/0157124 A1 * 6/2015 Cipolla ..... A47F 5/02 211/86.01
2015/0233639 A1 * 8/2015 Mustari ..... A47F 5/02 211/101
2015/0257534 A1 * 9/2015 Yang ..... A47K 3/281 211/119.011
2015/0327936 A1 * 11/2015 Coleman ..... A61G 13/107 211/1.52
2015/0366391 A1 * 12/2015 Peek ..... A47G 33/008 248/150
2016/0183737 A1 * 6/2016 Yang ..... F16B 7/105 211/119.009
2016/0187763 A1 * 6/2016 Fromm ..... G03B 17/561 396/428
2016/0192800 A1 * 7/2016 Haynesworth ..... A47H 1/022 211/105.6

* cited by examiner

VERTICALLY ADJUSTABLE SHOWER CADDY AND METHOD FOR TENSIONING SAME

CROSS-REFERENCE TO RELATED APPLICATIONS

The present patent application claims the benefits of priority of U.S. Patent Application No. 62/212,962, entitled "Vertically Adjustable Shower Caddy And Method For Tensioning Same", and filed at the U.S. Patent Office on Sep. 1, 2015, the content of which is incorporated herein by reference.

FIELD OF THE INVENTION

The present invention relates to shower caddy systems, and, more particularly, to shower caddy systems that include a vertical tension pole and shelves that may be attached to the pole at various locations along its length and a method for tensioning same.

BACKGROUND OF THE INVENTION

Shampoo bottles, bar and liquid soaps, shaving supplies and various other personal hygiene items are usually kept in the home bathroom shower stall or bathtub/shower area. Various shower caddies are available that have one or more shelves for holding the aforementioned items in an organized fashion. However, these system tend to have inadequate tensioning system and tend to fall easily. Other known systems are secured using screws and nails in the ceiling which require significant work for removing and disposing elsewhere.

Yet some other systems use spring loaded mechanism to tension the shower caddy. Spring tensioning systems lack the required strength usually obtained from the screws and nails alternative yet screws and nail alternative lack the versatility of the easy removal of the spring loaded mechanism. There is thus a need for a system that at least partially overcomes the short coming of existing systems.

SUMMARY OF THE INVENTION

The shortcomings of the prior art are generally mitigated by providing a vertically adjustable shower caddy having a conveniently reliable and easy to use tensioning system.

According to one aspect of the present invention, the vertically adjustable shower caddy provide a tensioning mechanism that may be durably secured to the shower stall or bathtub/shower area without the use of either screws and nails or spring loaded mechanisms.

According to one aspect of the present invention, the vertical shower caddy provide a vertically standing shower caddy comprising at least one tensioning mechanism securing the main structural pole segment, at least one shelf, and means for attaching and reattaching the at least one shelf to the at least one main structural pole segment at any point thereon. In one specific example, the attaching and reattaching means includes a securing mechanism using a dual mechanism with a clip having a first portion and a second portion, the first portion engaging the securing mechanism and the second portion providing a handle element for the user.

According to one aspect of the present invention, the vertical shower caddy comprise a hollow preferably non-circular main structural pole having two vertically extendable arms for securing the shower caddy to the floor and ceiling of shower stall or bathtub/shower without the need for any tools.

According to one aspect of the present invention, the shower caddy may be solidly secured using the tensioning mechanism simply by rotating either the upper or lower tensioning mechanisms or both. The dual extendable arm of the shower caddy allows the user to vertically align the main structural pole as desired. Therefore, the main structural pole may be located higher by retracting the upper extendable arm while extending the lower extendable arm by the same length.

According to one aspect of the present invention, the infinite screw tensioning mechanisms provide for a quick and easy installation. According to another aspect of the present invention, the shower caddy may be configured to be sold as one assembled piece, without the need for assembling thus improving the ease of installation by the user.

According to one aspect of the present invention, the tensioning mechanisms and its strength of installation allows the shower caddy to support significant weight while remaining in its initial position.

According to one aspect of the present invention, the top and bottom heads of the shower caddy may be suited with anti-slipping features that matches the material of the surface upon which they will be facing. For instance, the top head could be suited with a wood anti-slipping strip while the bottom head is suited with a ceramic anti-slipping strip. Therefore, the shower caddy may be suitably installed on any surfaces, while generally maintaining the desired strength. In addition, the thickness of the anti-slipping strip could be varied depending on the toughness of the material floor and ceiling materials.

According to one aspect of the present invention, though described as suitable for corner installation, the shower caddy could be configures for installation along a wall thus allowing the shelves a 180 degrees configuration as opposed to the 90 degrees corner configuration.

In another embodiment, the present invention includes a method for arranging the shelves of the shower caddy, comprising the steps of securing the main structural pole adjacent a shower location, attaching a first shelf on the tension pole at a first location thereon, removing the first shelf from the tension pole without moving the tension pole, and reattaching the first shelf on the tension pole at a second location thereon. Additionally, the method may comprise the step of adding the top head anti-slipping strip, the bottom head anti-slipping strip or both. Likewise, the method may further comprise the steps of choosing the height of the main structural pole and adjusting the upper and lower extendable arm as to vertically align the main structural pole as desired.

According to one aspect of the present invention, the shower caddy may be made from materials such as composite, aluminum, steel, polymers or any combination thereof. The materials used for the shower caddy will generally the strength of its installation.

According to one aspect of the present invention, a component of the shower caddy may be a bath or shower handle. According to one embodiment, the shower caddy and its securing mechanism allows the required for supporting a body without affecting the position of the shower caddy.

In yet another example, the method further comprises the step of securing a securing mechanism to main structural pole, wherein the steps of attaching the first shelf on the main structural pole and reattaching the first shelf on the main structural pole comprise securing the first shelf to the rail system. In yet another example, the method further comprises attaching a second shelf on the tension pole at a third location thereon, removing the second shelf from the tension pole without moving the tension pole, and reattaching the second shelf on the tension pole at a fourth location thereon.

According to aspect of the present invention, the shower caddy comprises: a tension pole and a plurality of shelves and/or accessories; each of the shelves and/or accessories having a securing element for mounting the shelves and/or accessories to the tension pole. The tension pole having a hollow structural pole having a first and a second extremity, a first vertically extendable received in the hollow structural pole and extending from the first extremity; and a first tensioning mechanism for vertically extending and retracting the first vertically extendable pole from the hollow structural pole. The first tensioning mechanism may be an infinite screw. The first vertically extendable arm and the main structural pole generally secure the shower caddy system to the floor and ceiling of a shower stall or a bathtub shower without requiring the use of any tools.

According to aspect of the present invention, it is disclosed a shower caddy comprising a second vertically extendable arm received in the hollow structural pole and extending from the second extremity, and a second tensioning mechanism for vertically extending and retracting the second vertically extendable pole from the hollow structural pole.

According to aspect of the present invention, it is disclosed an adjustable shower caddy system wherein the first vertically extendable pole engages the ceiling and wherein the second vertically extendable pole engages the floor, and wherein the main structural pole may be located vertically higher by retracting the first extendable arm of a first length. The extension of the first vertically extendable arm is achieved through rotating the first tensioning mechanism while extension of the second extendable arm is achieved through rotation of the second tensioning mechanism.

According to aspect of the present invention, it is disclosed an adjustable shower caddy system wherein the securing element comprises a dual mechanism with a clip having a first portion and a second portion, and wherein the first portion engaging the securing element and the second portion provides a handle element for the user.

According to aspect of the present invention, it is disclosed an adjustable shower which may be solidly secured to the floor and the ceiling of a shower stall or a bathtub shower using the tensioning mechanism simply by rotating either the first or second tensioning mechanism or both.

According to aspect of the present invention, it is disclosed an adjustable shower caddy having a hollow structural pole of cylindrical shape.

According to aspect of the present invention, it is disclosed an adjustable shower caddy with a cross section of the hollow structural pole having a triangular shape with rounded edges.

According to aspect of the present invention, it is disclosed an adjustable shower caddy pole comprising a first vertically extendable arm received in a hollow structural pole, the first vertically extendable arm having a first gear strip extending longitudinally. The hollow structural pole comprising a first retaining element having a first cylindrical lip, a second retaining element having a second cylindrical lip, a first cylindrical member having a third and a forth cylindrical lip, and an inner surface with first spiraling gears complementary with the first gear strip, and a main hollow member having a first and a second extremity, the first extremity being mounted to one of the first and second retaining elements. The first and second cylindrical lips rotatably receive the third and fourth cylindrical lips and the gear strip is received in a vertical portion of the spiraling gears. The rotation of the first cylindrical member about the first and second retaining element extends the vertically extendable arm while counter rotation of the first cylindrical member retracts the vertically extendable arm.

According to aspect of the present invention, it is disclosed an adjustable shower caddy pole further comprising a second vertically extendable arm received in the hollow structural pole, the second vertically extendable arm having a second longitudinal gear strip. The hollow structural pole further comprising a third retaining element having a fifth cylindrical lip, a fourth retaining element having a sixth cylindrical lip; a second cylindrical member having a seventh and a eighth cylindrical lip, and an inner surface with second spiraling gears complementary with the second longitudinal gear strip; and the second extremity of the hollow structural pole being mounted to one of the third and fourth retaining elements. The fifth and sixth cylindrical lips rotatably receiving the seventh and eight cylindrical lips. The second longitudinal gear strip being received in a vertical portion of the second spiraling gears. Accordingly, rotation of the second cylindrical member about the third and fourth retaining element extends the vertically extendable arm and wherein counter rotation of the second cylindrical member retracts the vertically extendable arm.

According to another aspect of the present invention, it is disclosed an adjustable shower caddy pole wherein the first cylindrical lip is on an inner surface of the first retaining element, the second cylindrical lip is on an inner surface of the second retaining element, the third and fourth cylindrical lips on an outer surface of the first cylindrical member.

According to another aspect of the present invention, it is disclosed an adjustable shower caddy pole wherein the first cylindrical lip is on an outer surface of the first retaining element, the second cylindrical lip is on an outer surface of the second retaining element, the third and fourth cylindrical lips on an inner surface of the first cylindrical member.

According to yet another aspect of the present invention, it is disclosed an adjustable shower caddy pole wherein the sixth cylindrical lip is on an inner surface of the third retaining element, the seventh cylindrical lip is on an inner surface of the fourth retaining element, the third and fourth cylindrical lips on an outer surface of the second cylindrical member.

According to yet another aspect of the present invention, it is disclosed an adjustable shower caddy pole wherein the sixth cylindrical lip is on an outer surface of the third retaining element, the seventh cylindrical lip is on an outer surface of the fourth retaining element, the third and fourth cylindrical lips on an inner surface of the second cylindrical member.

According to yet another aspect of the present invention, it is disclosed an adjustable shower caddy pole wherein a cross-section of the elongated hollow member is non-circular to favor installation in corner spaces.

According to yet another aspect of the present invention, it is disclosed an adjustable shower caddy pole wherein the first vertically extendable arm has a securing head, the securing head being configured in use to abut on one of a floor or a ceiling of a shower stall or a bathtub shower.

According to yet another aspect of the present invention, it is disclosed an adjustable shower caddy pole wherein a cross-section of the elongated hollow member has triangular shape with rounded edges. The elongated hollow member may also have a first longitudinal rail for mounting shelves and accessories and a second longitudinal rail within the first longitudinal rail for receiving a securing element of the shelves and accessories The shelves and accessories may be slideable along the first longitudinal rail and secured about the second longitudinal rail.

According to yet another aspect of the present invention, it is disclosed an adjustable shower caddy pole comprising a first vertically extendable arm received in a hollow structural pole, the first vertically extendable arm having a first longitudinal gear strip. The hollow structural pole comprising a first cylindrical member having a top surface, a bottom surface and an inner surface with first spiraling gear complementary with the first longitudinal gear strip and an elongated hollow member having a first and a second extremity, the first extremity of the elongated hollow member being disposed about the first cylindrical member. The first longitudinal gear strip is received in a vertical portion of the first spiraling gear and wherein rotation of the first cylindrical member about the hollow structural pole outwardly extends the first vertically extendable arm and wherein counter rotation of the first cylindrical member inwardly retracts the first vertically extendable arm.

According to yet another aspect of the present invention, it is disclosed an adjustable shower caddy pole comprising a second vertically extendable arm received in the hollow structural pole, the second vertically extendable arm having a second longitudinal gear strip. The hollow structural pole further comprising a second cylindrical member having a top surface, a bottom surface and an inner surface with a second spiraling gear complementary with the second longitudinal gear strip. The second longitudinal gear strip being received in a vertical portion of the second spiraling gear. Accordingly, rotation of the second cylindrical member about the hollow structural pole outwardly extends the second vertically extendable arm and wherein counter rotation of the first cylindrical member inwardly retracts the vertically extendable arm.

According to yet another aspect of the present invention, it is disclosed adjustable tensioning system comprising a tension pole and a plurality of shelves, accessories or both, each having a securing element for mounting the shelves, the accessories or both to the tension pole; wherein the first tensioning mechanism comprises a lead screw and nut assembly; wherein the first vertically extendable arm and the hollow structural pole secure the shower caddy system to an upper horizontal surface and a lower horizontal surface of a bathroom, a shower stall or a bathtub shower without requiring the use of any tools. The a tension pole comprising a hollow structural pole having a first and a second extremity; a first vertically extendable arm received in the hollow structural pole and extending from the first extremity; and a first tensioning mechanism for vertically extending and retracting the first vertically extendable arm from the hollow structural pole.

According to yet another aspect of the present invention, it is disclosed method for arranging shelves on a caddy pole the method comprising the steps of:

- securing the hollow structural pole adjacent a shower location,
- attaching a first shelf on the caddy pole at a first location thereon,
- removing the first shelf from the tension pole without moving the tension pole, and
- reattaching the first shelf on the tension pole at a second location thereon.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which:

FIG. 8 is a cross-sectional view of the vertical adjustable shower caddy of FIG. 7 along A-A axis.

DETAILED DESCRIPTION OF THE PREFERRED EMBODIMENT

A novel vertical adjustable shower caddy will be described hereinafter. Although the invention is described in terms of specific illustrative embodiments, it is to be understood that the embodiments described herein are by way of example only and that the scope of the invention is not intended to be limited thereby.

Figure 1:
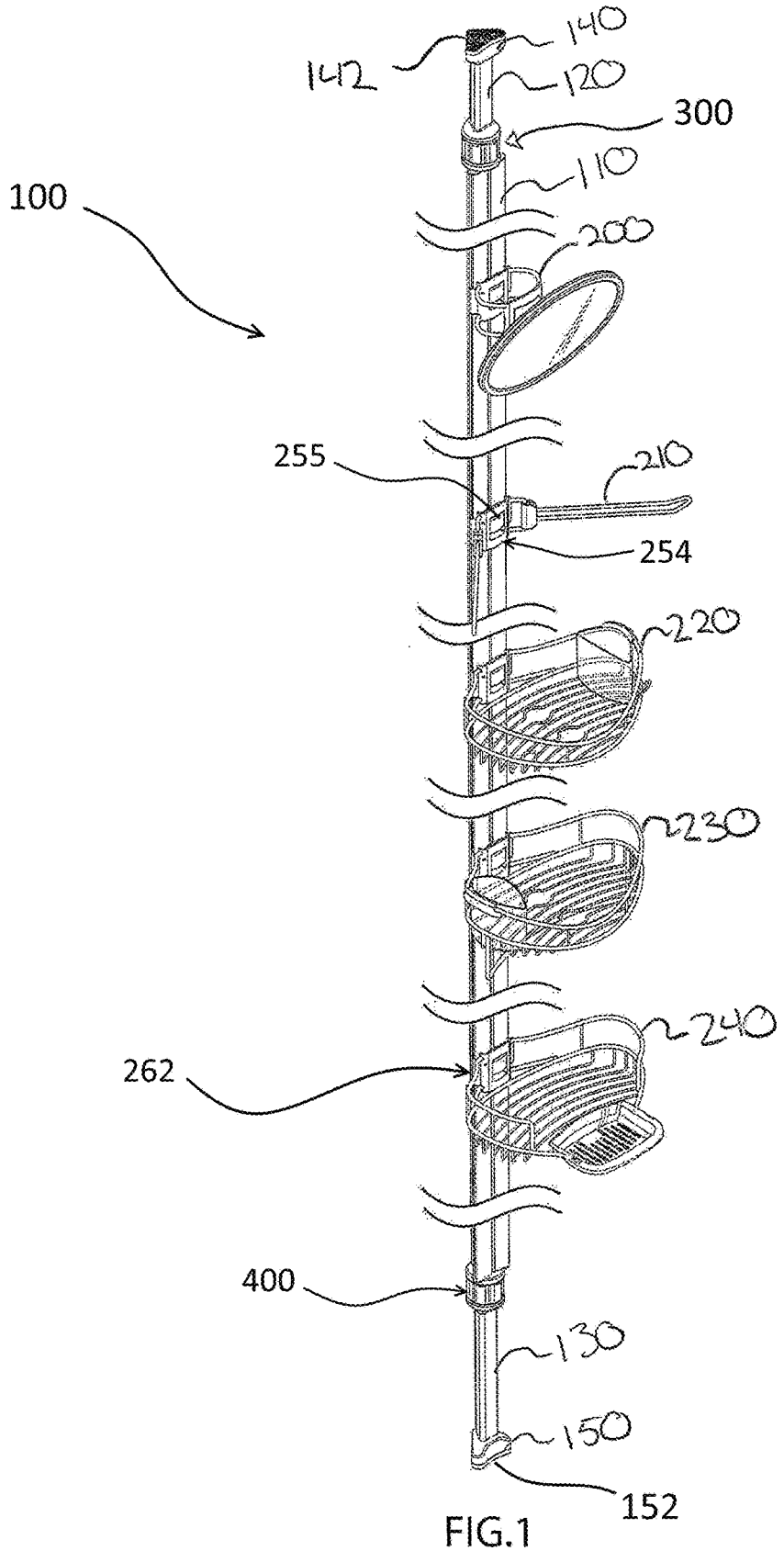
FIG. 1 is a perspective view of a vertical adjustable shower caddy.
Figure 2:
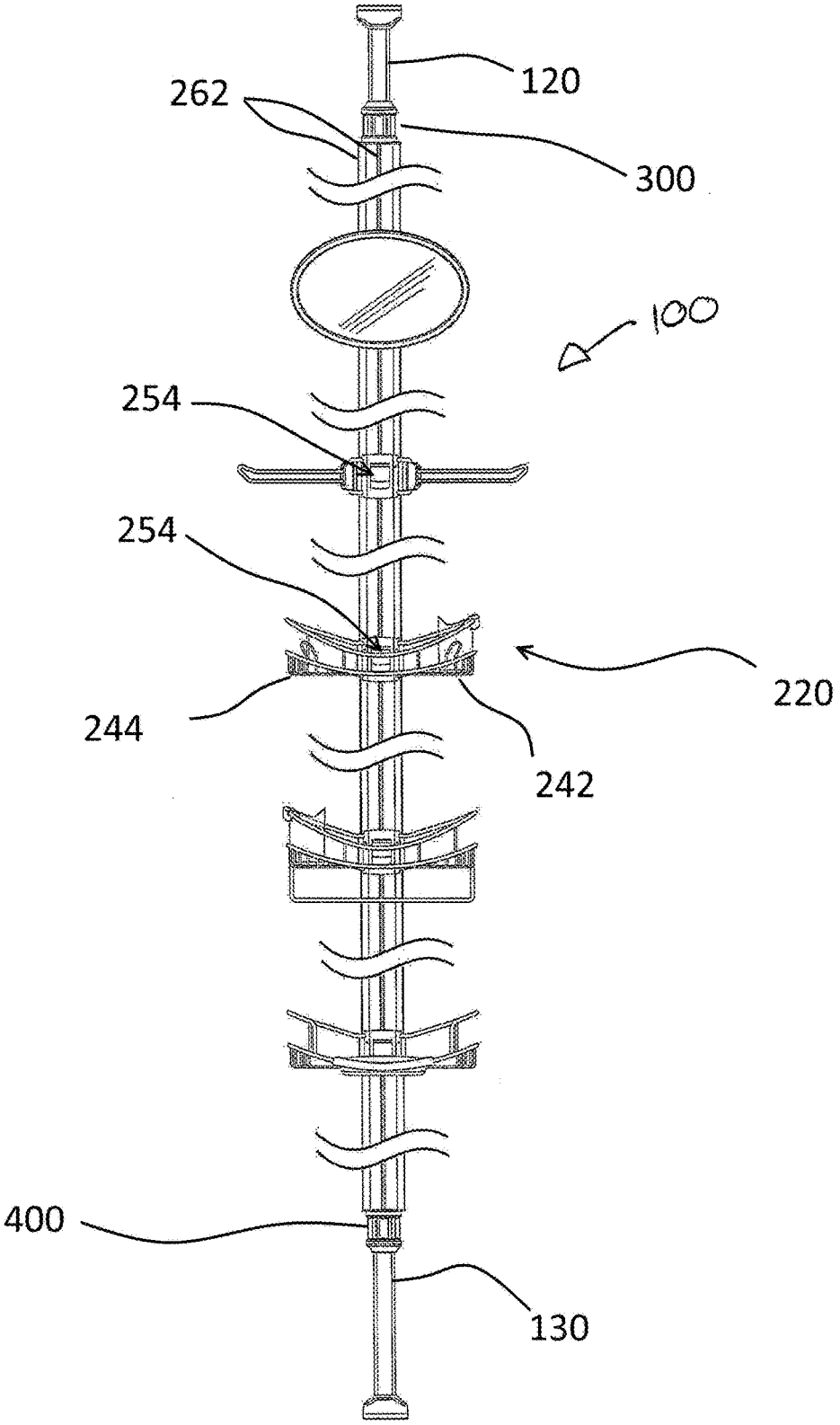
FIG. 2 is a front elevation view of the vertical adjustable shower caddy of FIG. 1.
Figure 3:
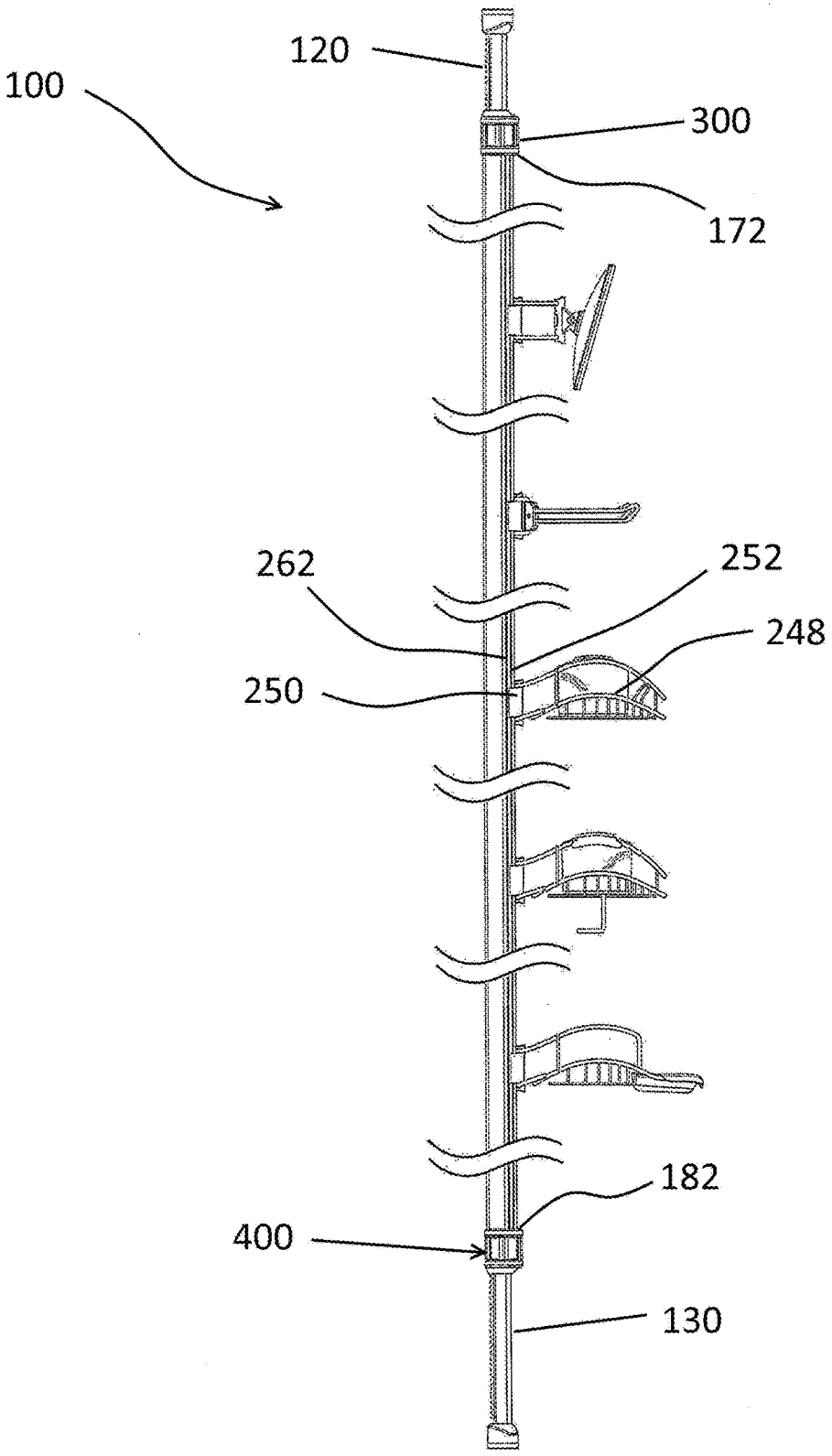
FIG. 3 is a left side elevation view of the vertical adjustable shower caddy of FIG. 1.

Referring first to FIGS. 1-3, an embodiment of a vertically adjustable shower caddy 100 in accordance with the principles of the present invention is shown. In the present embodiment, the shower caddy 100 comprises a main structural pole 110, an upper extendable arm 120, a lower extendable arm 130, both the upper and lower extendable arms 120, 130 being operatively interconnected to the main structural pole 110 using tensioning mechanisms 300, 400. The shower caddy 100 is adapted for installation in a home bathroom shower stall or adjacent a bathtub/shower area.

In the present embodiment, going from top to bottom, the shower caddy 100 generally comprises a top head 140 having an anti-slipping membrane 142 on the its top outer surface, a top extendable arm 120, a upper tensioning mechanism 300 interconnecting the upper extendable arm 120 with the main structural pole 110 having a rail system 262 for operatively mounting several storage compartments and accessories 200, 210, 220, 230, 240, a lower tensioning mechanism 400 interconnecting the main structural pole 110 and a lower extendable arm 130 and a lower head 150, also preferably an anti-slipping membrane located thereunder 152. The main structural pole 110 is generally hollow to receive the upper and lower extendable arms 120, 130. In the present embodiment, the main structural pole 110 has a triangular shape to be conveniently received in either a bath or shower corner.

Figure 4:
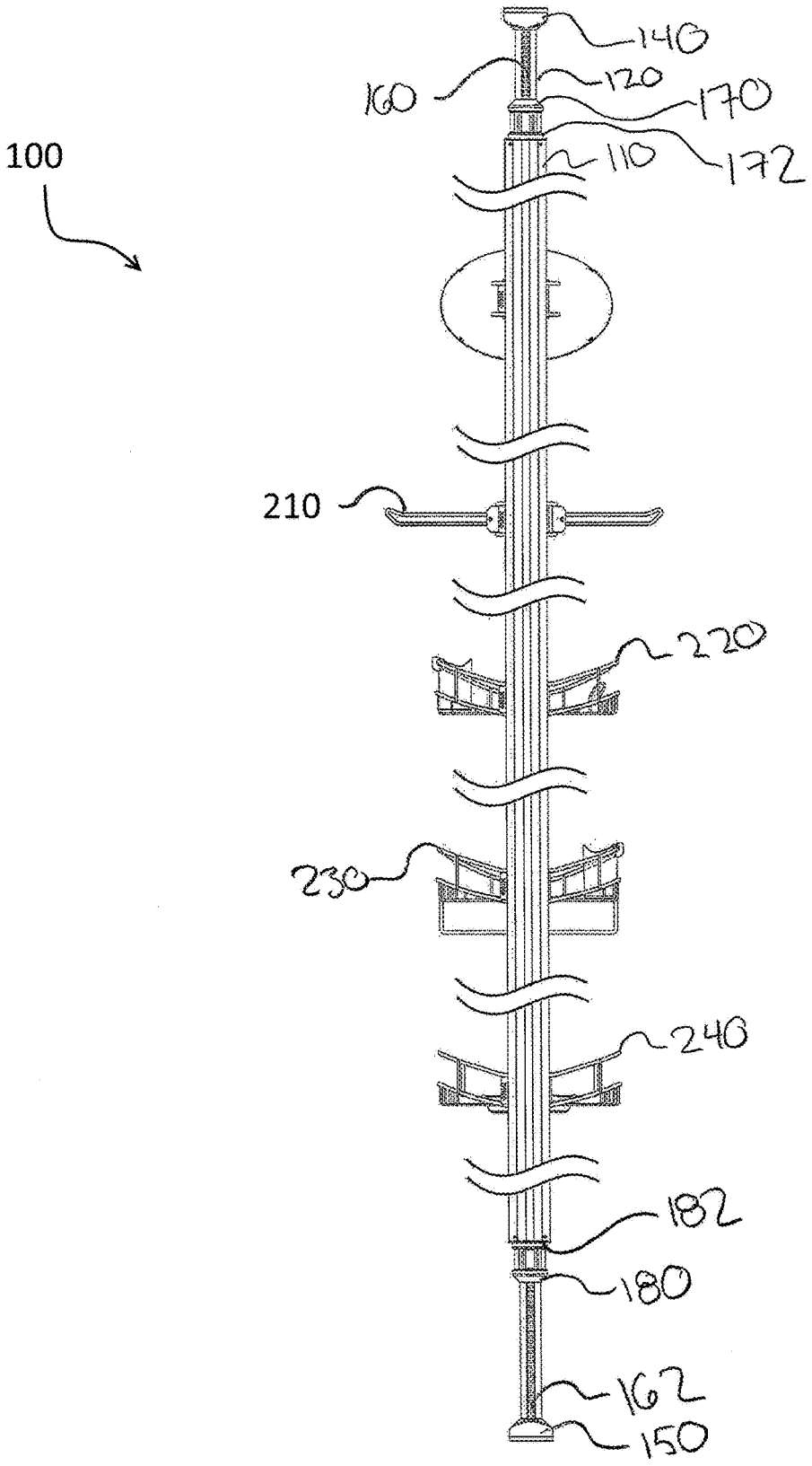
FIG. 4 is a rear elevation view of the vertical adjustable shower caddy of FIG. 1.
Figure 5:
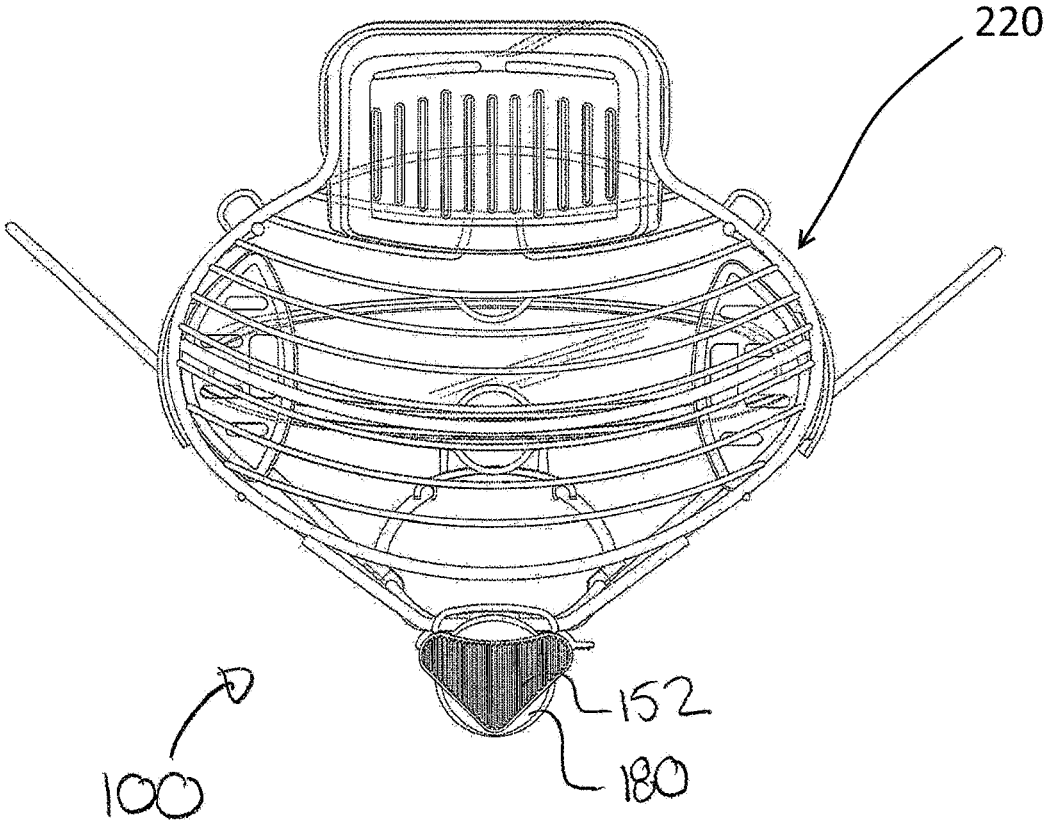
FIG. 5 is a bottom plan view of the vertical adjustable shower caddy of FIG. 1.
Figure 6:
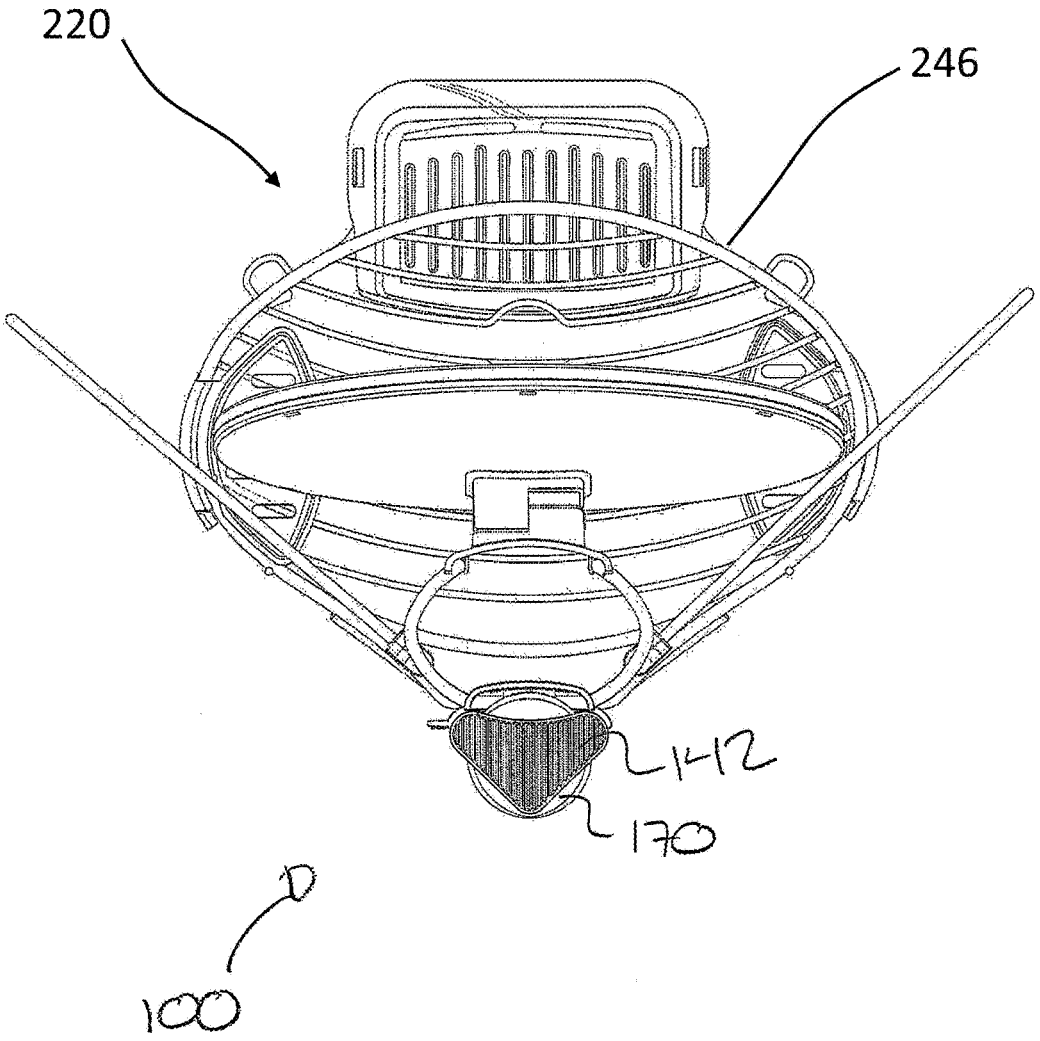
FIG. 6 is a top plan view of the vertical adjustable shower caddy of FIG. 1.

Now referring to FIGS. 4-6 in the present embodiment, the shower caddy 100 is shown having interconnecting components comprising the upper tensioning mechanism 300 and upper extendable arm 120 operatively inserted within the main structural pole 110. The main structural pole 110 comprises an inner and outer surfaces 112, 114, with upper and lower retaining elements 170 and 180 on both its respective ends, upper and lower tensioning mechanism 300 and 400, mounted on either upper and lower retaining elements 172, 182. Now referring to the upper tensioning mechanism, the lower mechanism being similar in the opposite direction.

Figure 7:
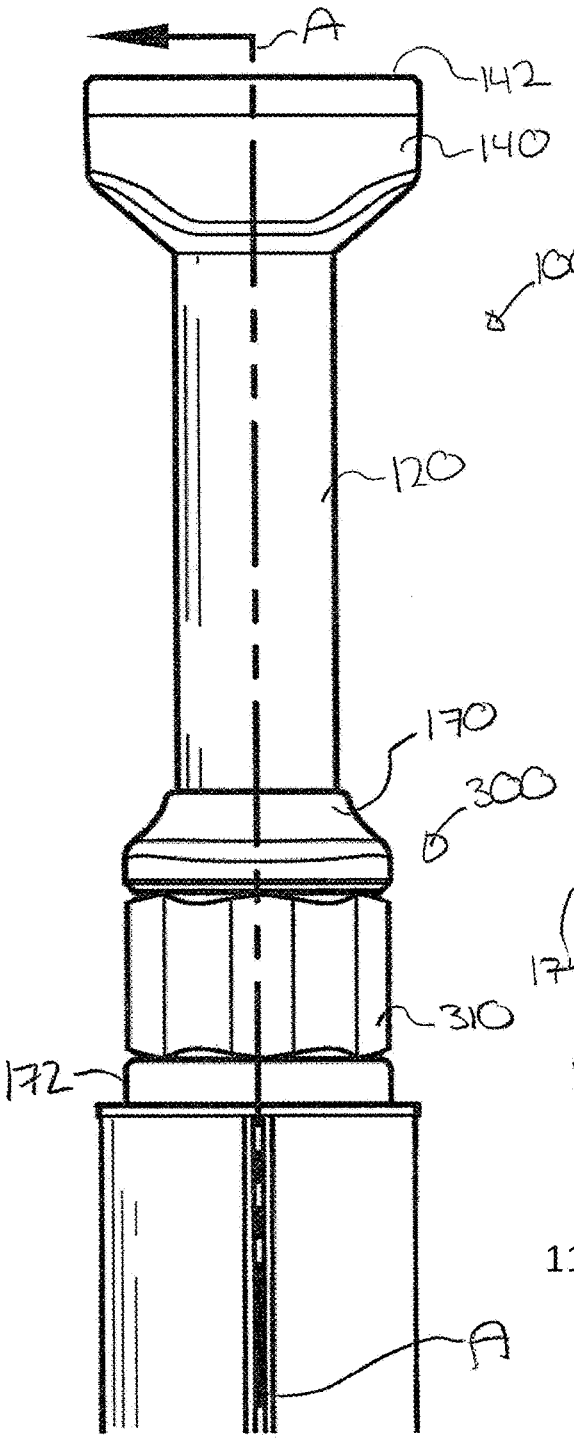
FIG. 7 is a front elevation closed up view of the upper portion of the of the vertical adjustable shower caddy of FIG. 1.
Figure 8:
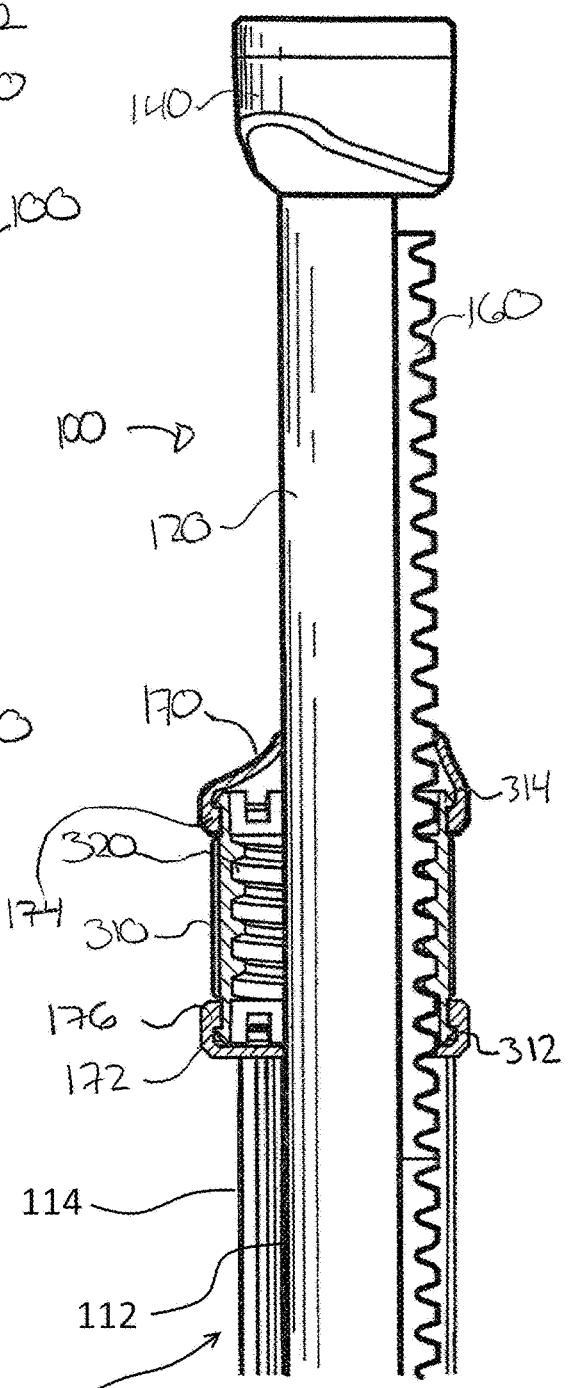
FIG. 8 is a cross-sectional view of a portion of the vertical adjustable shower caddy of FIG. 7 along A-A axis.
Figure 9:
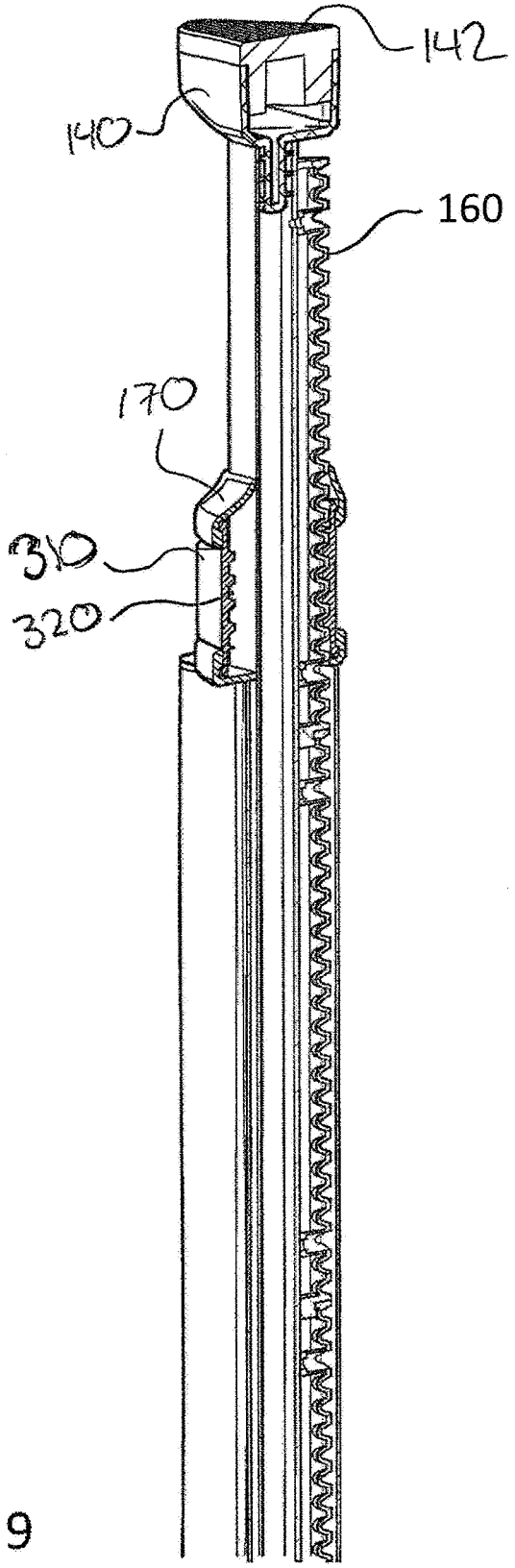
FIG. 9 is

Now referring to FIGS. 7-9, in the present embodiment, the upper tensioning mechanism 300 comprises a tensioning element 310 rotatably mounted on the main structural pole 110. The upper and lower extremities of the tensioning element 310 respectively have annular hooks 314 and 312 for retaining the tensioning element 310 through the upper retaining element 172 and lower recess 176 of the upper retaining element 172 and upper retaining element 170. The tensioning element 310 act as an infinite screw. As the tensioning element is rotated the upper extendable arm 120 is extended or retracted from the main structural pole 110. The extension and retraction of the extendable arm 120 is a result of the interaction between a spiraling gear 320 of the tensioning element 310 and complementary mating gear strip 160 located on at least one side of the upper extendable arm 120.

In another embodiment, the shower caddy system 100 also comprises one or more self-draining shelves 220, 230, 240, as illustrated in FIGS. 1 and 3. By way of example, FIG. 1-5 illustrates shelves 220, 230 and 240 that are shaped for placement in the corner of a shower stall or bathtub/shower area as exemplified by the 90 degrees angle between the left 244 and right 242 supporting shelf members.

More particularly, the shelf 220 includes a, elliptical-shaped frame 246 having left 244 and right 242 supporting shelf members, a lowered curved front section 248 and a securing element 250. The securing element 250 has a dual attachment mechanism. The first mechanism is a laterally engaging side attachment element 252, substantially engaging the rail system of the main structural pole 110. The laterally engaging side attachment element 252, releasably secures the securing element to the rail system 262 by engaging a recess through the second rail arm. Therefore, the first securing mechanism is used for mounting the shelves 220, 230, 240 and other components accessories 200, 210 to the rail system 262 of the main structural pole 110. The second securing mechanism, is a clip 254 that is moved upwardly and downwardly to vertically secure the securing mechanism at a desired height.

In another embodiment, with reference to FIGS. 1-5, the shower caddy system 100 is provided with one or more securing elements 250 for attaching the shelves 220, 230, 240 to the main structural pole 110 rail system (i.e., one securing mechanism 250 is provided for each shelf 220, 230, 240 to be attached to the main structural pole 110 via its rail system). The securing mechanism 250 also facilitates the removal and the reattachment of the shelves 220, 230, 240, for example, at another point on the main structural pole 110, as further explained hereinbelow.

In use, the shower caddy system 100 may be installed according to the following steps. Once assembled, as described above, the main structural pole 110 may be secured in a shower stall or adjacent a bathtub/shower area. More particularly, the upper and lower extendable arm 120, 130 may be tensioned using the tensioning mechanisms 300, 400 temporarily increasing or decreasing the length of the shower caddy 100 and thereby allowing a user to secure the shower caddy 100 between the ceiling and floor of a shower stall or between the ceiling and the tub of the bathtub/shower area of a bathroom. Once the shower caddy 100 is positioned, the upper and lower extendable arm 120, 130 may be tensioned using the tensioning mechanisms 300, 400 to increase the tension and secure the shower caddy 100. The shower caddy 100 is secured in place via an interference or friction fit with the ceiling and shower stall floor or bathtub.

According to one embodiment, a first location 260 on the main structural pole 110 is selected for placement of a first shelf 240, and a first securing mechanism 250 is secured to the rail system 262 of the main structural pole 110 at the first location 260, as illustrated in FIG. 3. More particularly, the first portion 255 of the clip 254 is moved from its second position (vertically locking the securing mechanism to the rail system) to its first position (unlocking and allowing free movement of the securing mechanism along the rail system 262), so that the clip 254 is open. The clip 254 is then placed around the main structural pole 110 at the first location 260, with the first portion engaging one side of the rail system 262 and the second portion engaging the opposite side of the rail system 262.

According to one embodiment, with the securing mechanism 250 of the present invention, there is no need to remove the entire shower caddy 100 to move one or more of the shelves 220, 230, 240. More particularly, repositioning a shelf 220, 230, 240 to a new location on the main structural pole 110 does not require the removal of the main structural pole 110 from the shower stall or bathtub/shower area, and thereby saves a user a significant amount of time and effort. To vertically reposition a shelf 220, 230, 240, the shelf 220, 230, 240 is lifted along the rail 262 after having first disengaged the clip 254 locking member until it is disengaged from its associated rail element. More particularly, the first portion 255 of the clip 254 is moved from its second position (vertically locking the securing mechanism to the rail system) to its first position (unlocking and allowing free movement of the securing mechanism along the rail system 262), so that the clip 254 is open.

According to one embodiment, to invert the position of the shelves along the main structural pole 110, the shelves 220, 230, 240 may be removed from the rail 262 by lifting the clip 254 and laterally displacing the side attachment element 252 thus disengaging the securing mechanism from the rail and allowing removal of the individual shelf 220, 230, 240 or components accessories from the main structural pole. As such, a shelf 220, 230, 240 may then be moved from its initial position to a second position along the main structural pole 110. The securing mechanism 250 is secured to the main structural pole 110 the new location by engaging the first rail arm and laterally displacing the side attachment element 252 to engage the second rail arm thus mounting the securing mechanism 250 to the rail system 262 and then lowering the clip 254 to is locked position and vertically selecting the position of the shelf and securing mechanism 250.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. An adjustable shower caddy pole the adjustable shower caddy pole comprising:

an elongated hollow structural pole having a first and a second extremity end;

a first vertically extendable arm received in the hollow structural pole, the first vertically extendable arm having a vertical length, at least two sides, and a first gear strip with a first series of continuous teeth protruding from at least one of the sides of the first vertically extending arm, wherein at least one of the sides is free from having teeth;

the first gear strip extending a substantially portion of the vertical length of the first vertically extendable arm; the hollow structural pole comprising:

a first tensioning member having a top surface, a bottom surface and an inner surface having a first spiraling gear with a second series of continuous teeth which complementary mates with corresponding teeth of the first gear strip, the inner surface of the first tensioning member being disposed about and surrounding the first vertically extendable arm;

the first gear strip being received in a vertical portion of the first spiraling gear; wherein rotation of the entire first tensioning member about the first vertically extendable arm outwardly extends the first vertically extendable arm and wherein counter rotation of the entire first tensioning member inwardly retracts the first vertically extendable arm.

2. The adjustable shower caddy pole of claim 1, further comprising a second vertically extendable arm received in the hollow structural pole, the second vertically extendable arm having a second gear strip extending longitudinally;

the hollow structural pole further comprising:

a second tensioning member having a top surface, a bottom surface and an inner surface with a second spiraling gear complementary with the second gear strip;

the second gear strip being received in a vertical portion of the second spiraling gear;

wherein rotation of the second tensioning member about the hollow structural pole outwardly extends the second vertically extendable arm and wherein counter rotation of the second tensioning member inwardly retracts the second vertically extendable arm.

3. The adjustable shower caddy pole of claim 1, wherein either the top or the bottom surface of the first tensioning member abuts on the first extremity of the elongated hollow structural pole.

4. The adjustable shower caddy pole of claim 1, wherein the hollow structural pole further comprises:

a first retaining element having a first lip; and a second retaining element having a second lip; the first tensioning member having a third and a forth lip; the first extremity of the elongated hollow structural pole being mounted to one of the first and second retaining elements;

the first and second lips rotatably receiving the third and fourth lips.

5. The adjustable shower caddy pole of claim 1, further comprising a second vertically extendable arm received in the hollow structural pole, the second vertically extendable arm having a second gear strip; the hollow structural pole further comprising:

a third retaining element having a fifth lip; a fourth retaining element having a sixth lip;

a second tensioning member having a seventh and a eighth lip, and an inner surface with a second spiraling gear complementary with the second gear strip; and the second extremity being mounted to one of the third and fourth retaining elements;

the fifth and sixth lips rotatably receiving the seventh and eight lips;

the second gear strip being received in a vertical portion of the second spiraling gear;

wherein rotation of the second tensioning member about the third and fourth retaining element outwardly extends the second vertically extendable arm and wherein counter rotation of the second tensioning member inwardly retracts the second vertically extendable arm.

6. The adjustable shower caddy pole of claim 4, wherein the first lip is on an inner surface of the first retaining element, the second lip is on an inner surface of the second retaining element, the third and fourth lips on an outer surface of the first tensioning member.

7. The adjustable shower caddy pole of claim 5, wherein the sixth lip is on an inner surface of the third retaining element, the seventh lip is on an inner surface of the fourth retaining element, the third and fourth lips on an outer surface of the second tensioning member.

8. The adjustable shower caddy pole of claim 1, wherein a cross-section of the elongated hollow structural pole is shaped to favor installation in corner spaces.

9. The adjustable shower caddy pole of claim 1, wherein the first vertically extendable arm has a securing head, the securing head being configured to abut on one of an upper horizontal surface and a lower horizontal surface of a bathroom, a shower stall or a bathtub shower.

10. The adjustable shower caddy pole of claim 1 wherein a cross-section of the elongated hollow structural pole has a triangular shape with rounded edges.

11. The adjustable shower caddy pole of claim 1, wherein the elongated hollow structural pole has a first longitudinal rail for mounting shelves and accessories.

12. The adjustable shower caddy pole of claim 11, wherein the elongated hollow structural pole has a second longitudinal rail for receiving a securing element of the shelves and accessories.

13. The adjustable shower caddy pole of claim 11, wherein shelves and accessories are slideable along the first longitudinal rail.

14. The adjustable shower caddy pole of claim 12, wherein the securing element comprises a dual mechanism having a laterally engaging side attachment element and a clip, wherein the laterally engaging side attachment element releasably secures the securing element to the structural pole and the clip is moved upwardly or downwardly to adjust the height of the securing element.

* * * * *